US007618592B2

(12) United States Patent
Burnham et al.

(10) Patent No.: US 7,618,592 B2
(45) Date of Patent: Nov. 17, 2009

(54) DETACHABLE ENGAGEABLE MICROARRAY PLATE LINER

(75) Inventors: Richard T. Burnham, Gloucester, MA (US); Joseph P. Lane, Methuen, MA (US); Christopher A. Scott, Westford, MA (US); Steven D. Sheridan, Wakefield, MA (US); Richard J. Shafner, Lynnfield, MA (US)

(73) Assignee: Millipore Corporation, Billerica, MA (US)

( * ) Notice: Subject to any disclaimer, the term of this patent is extended or adjusted under 35 U.S.C. 154(b) by 770 days.

(21) Appl. No.: 11/142,542

(22) Filed: Jun. 1, 2005

(65) Prior Publication Data

US 2005/0287046 A1 Dec. 29, 2005

Related U.S. Application Data

(60) Provisional application No. 60/676,472, filed on Apr. 29, 2005, provisional application No. 60/582,636, filed on Jun. 24, 2004.

(51) Int. Cl.
*B01L 3/00* (2006.01)

(52) U.S. Cl. ..... 422/102; 422/100; 422/101

(58) Field of Classification Search ..... 422/99, 422/100, 102

See application file for complete search history.

(56) References Cited

U.S. PATENT DOCUMENTS

| | | | | |
|---|---|---|---|---|
| 4,902,481 | A | 2/1990 | Clark et al. | |
| 4,948,564 | A | 8/1990 | Root et al. | |
| 5,108,704 | A | 4/1992 | Bowers et al. | |
| 5,141,719 | A | 8/1992 | Fernwood et al. | |
| 5,264,184 | A | 11/1993 | Aysta et al. | |
| 5,464,541 | A | 11/1995 | Aysta et al. | |
| 6,159,368 | A | 12/2000 | Moring et al. | |
| 6,338,802 | B1 | 1/2002 | Bodner et al. | |
| 6,391,241 | B1 | 5/2002 | Cote et al. | |
| 6,419,827 | B1 | 7/2002 | Sandell et al. | |
| 6,517,781 | B1 * | 2/2003 | Coassin et al. | 422/102 |
| 2002/0006361 | A1 | 1/2002 | Sanadi | |
| 2002/0104795 | A1 | 8/2002 | Cote et al. | |
| 2002/0155034 | A1 | 10/2002 | Perman | |
| 2002/0195386 | A1 | 12/2002 | Young et al. | |
| 2003/0226796 | A1 * | 12/2003 | Bayer et al. | 210/259 |
| 2005/0051471 | A1 | 3/2005 | Lane et al. | |

FOREIGN PATENT DOCUMENTS

| | | |
|---|---|---|
| EP | 0339769 | 11/1989 |
| EP | 1477812 | 11/2004 |
| EP | 1524033 | 4/2005 |
| WO | WO 01/51206 | 5/2000 |
| WO | WO 01/45844 | 12/2000 |
| WO | WO 02/96563 | 5/2002 |

* cited by examiner

*Primary Examiner*—Yelena G Gakh
*Assistant Examiner*—David Weisz

(57) ABSTRACT

A plate liner detachably engageable onto a microarray plate (or underdrain plate component thereof), suited for preventing or confining pendant drop formation. It is provided either as a stand-alone item, or—preferably—in kit form, within a sanitary package, together with other pre-matched microarray filtration components.

14 Claims, 4 Drawing Sheets

DETACHABLE ENGAGEABLE MICROARRAY PLATE LINER

CROSS-REFERENCE TO RELATED APPLICATION

This application claims the benefit of U.S. Provisional Application No. 60/676,472, filed on Apr. 29, 2005 and U.S. Patent Application Ser. No. 60/582,636, filed Jun. 24, 2004.

BACKGROUND

Chemistry on the microscale, involving the reaction and subsequent analysis of reagents or analytes in microliter volumes or smaller, is an increasingly important aspect of the study and/or development of substances in the pharmaceutical and other industries. In certain instances, the reagents or analytes are scarce or otherwise not easily obtainable. In other instances, such as is prevalent in biopharmaceutical research, the analytical objectives sought call for the extraction of a vast library of information from a correspondingly vast number of assays. In either instance—whether by necessity (as in the former) or as a practical matter (as in the latter)—microscale chemistry provides apparent and distinct advantages.

Often in biopharmaceutical research, an assay, as part of its protocol, requires a fluid filtration step, for example, to either purify or isolate a particular biochemical target. For conducting several of such assays contemporaneously, so-called "multiwell plates" have become the tool of choice. These are now mass produced and obtainable easily from several commercial venues (e.g., Millipore Corporation of Billerica, Mass.). They are generally fast, easy to use, comparatively inexpensive, and amenable to automated robotic processes.

Multiwell plates are frequently used, for example, to incubate microcultures or to separate biological or biochemical material followed by further processing to harvest the material. Each well in a typical multiwell plate is provided with separation material so that, upon application of suitable force (e.g., a vacuum) to one side of the plate, fluid in each well is expressed through the filter, leaving solids (e.g., bacteria, precipitated protein, and the like) entrapped therein. The separation material can also act as a membrane such that the predetermined target is selectively bonded or otherwise retained. The retained target can thereafter be harvested by means of a further solvent. The liquid expressed from the individual wells through the separation material can be collected in a common collecting vessel (e.g., in instances wherein the liquid is not needed for further processing), or alternatively, in individual collecting containers.

Existing multiwell plates are often manufactured in 6-well, 24-well, 96-well, 384-well, and 1536-well formats, each well typically having a predetermined maximum volume capacity ranging between approximately 1 microliter to approximately 5 milliliters. Typically, each well in a multiwell plate is provided with a corresponding underdrain downstream of the separation material. The underdrain—often provided with a spout—essentially controls or otherwise affects the nature of and manner in which fluid is discharged out each well.

Multiwell plates having underdrains with spouts are disclosed, for example, in U.S. Pat. No. 4,902,481, issued to P. Clark et aL. on Feb. 20, 1990; U.S. Pat. No. 5,264,184, issued to J. E. Aysta et al. on Nov. 23, 1993; U.S. Pat. No. 5,464,541, issued to J. E. Aysta et al. on Nov. 7, 1995; U.S. Pat. No. 5,108,704, issued to W. F. Bowers et al. on Apr. 28, 1992; U.S. patent Application. Pub. No. 2002/0,195,386, filed by S. G. Young et al. on Jun. 25, 2002; U.S. Pat. No. 4,948,564, issued to D. Root et al. on Aug. 14, 1990; U.S. patent application Pub. No. 2002/0,155,034, filed by C. A. Perman on Jun. 11, 2002; U.S. Pat. No. 6,338,802, issued to K. S. Bodner et al on Jan. 15, 2002; U.S. Pat. No. 6,159,368, issued to S. E. Moring etal. on Dec. 12, 2000; U.S. Pat. No. 5,141,719, issued to G. C. Fernwood et al. on Aug. 25, 1992; U.S. Pat. No. 6,391,241, issued to R. A. Cote et al. on May 21, 2002; U.S. patent application Pub. No. 2002/0,104,795, filed by R. A. Cote et al. on Mar. 28, 2002; U.S. Pat. No. 6,419,827, issued to D. R. Sandell et aL. on Jul. 16, 2002; PCT International Patent Application Pub. No. WO 02/096563, filed by J. Kane et al. on May 29, 2002; PCT International Patent Application Pub. No. WO 01/51206, filed by T. Vaaben et al. on May 8, 2000; and PCT International Patent Application Pub. No. WO 01/45, 844, filed by K. A. Moll on Dec. 21, 2000.

While these and other multiwell plates are still widely used, need is felt for both structural and functional improvements thereto. Areas of particular interest include, but are not limited to, the control of so-called "pendant drop formation", cross-talk between wells, and robotic automation.

In particular, as known by those skilled in the art, fluid is often expressed (intentionally or not) through a multiwell plate in drops. The nature of drop formation will affect the conduct of robotic automation, for example, the speed, precision, and sensitivity thereof. Undesirable drop formation and dripping can lead, for example, to sample loss, leakage, splattering, cross contamination (i.e., cross talk), exposure to hazardous media, downstream equipment contamination, and the like. Loss of information, diagnostic failures, and other (potentially catastrophic) inaccuracies can result. These and other like issues are particularly pronounced in protocols that involve comparatively long storage and/or incubation periods.

SUMMARY

In general, the present invention is directed to means for controlling pendant drop formation in microarrays, and in particular, to a detachably engageable plate liner.

In light of the aforementioned need, the present invention provides a plate liner suited for controlling pendant drop formation. The plate liner is configured to engage firmly, but detachably, onto a specific pre-defined microarray such that the force required to manually detach (i.e., "disengage") it from the microarray is substantially less than the force that would result in the disengagement, fracturing, division, or otherwise separation of the complementary array of wells and underdrains that constitute the microarray. The plate liner, in particular, comprises an array of hermetic spout isolators that will register "one-for-one" with the underdrains when the plate liner is engaged onto said specific pre-defined microarray. When engaged, any fluid placed in said wells and passing into said underdrains is hermetically blocked from flowing past the hermetic spout isolators.

In general, the plate liner is pre-configured to "engage" via two alternative approaches. In the first approach—preferably used to completely seal off the underdrain spouts—the plate liner is engineered to "engage detachably" by means of friction-fitted coupling of the hermetic spout isolators with the underdrain spouts. In the other approach—preferably used when the hermetic spout isolators are formed as "micro-receptacles" incapable of "holding onto" the underdrain spouts—the plate liner is engineered such that it "engages detachably" by means of friction-fitted peripheral edge coupling of the plate liner onto the microarray.

In a desirable embodiment, the invention is provided as a kit that contains, within a sanitary package, the following: (a) a sample plate comprising an array of wells; (b) a drain plate comprising an array of underdrains detachably or permanently attached onto said sample plate such that the underdrains are in register with said wells; and (c) the plate liner. The plate liner is desirably pre-sterilized and—as mentioned—designed for firm, yet detachable, engagement.

In another desirable embodiment, the hermetic spout isolators of the plate liner are formed as micro-receptacles optically configured to enable, for example, automated optical interrogation of fluid captured therein.

In a further desirable embodiment, the hermetic spout isolators of the plate liner are formed as micro-receptacles optically configured to enable, for example, automated optical interrogation of fluid captured therein and the web between the isolators is rendered opaque so as to reduce or eliminate light scatter between the wells.

In another desirable embodiment, the hermetic spout isolators of the plate liner are formed so that their inner bottom surface is closely adjacent to or touching the spout of the underdrain above, effectively preventing any drop to form or any appreciable amount of liquid to leave the underdrain or well above it.

In light of the above, it is a principal object of the present invention to provide a plate liner suited for controlling pendant drop formation in microarray devices.

It is another object of the present invention to provide said plate liner within a kit format that is desirably "pre-sterilized", contains "pre-matched" components, and is essentially "ready-for-use".

It is another object of the present invention to provide a plate liner that firmly, but detachably, engages onto a microarray (or underdrain plate thereof) by means of friction-fitted couplings of the tray's hermetic spout isolators with the microarray's underdrain spouts It is another object of the present invention to provide a plate liner that firmly, but detachably, engages onto a microarray (or underdrain plate thereof) by means of friction-fitted peripheral edge coupling of the plate liner onto the microarray (or underdrain plate thereof).

It is another object of the present invention to provide a "plate liner" based approach that enables incubation of microarray plated samples over comparatively long periods of time, with minimized pendant drop leakage.

It is another object of the present invention to provide a "plate liner" based approach that reduces or eliminated undesirable leakage during microarray handling protocols that involve physical agitation (i.e., shaking), and/or microfiltration protocols that involve low surface tension fluids (e.g., low molecular weight alcohols and surfactants).

It is another object of the present invention to provide a plate liner useful for resolving pendant drop formation issues in a microarray plate, and—when combined with a plate lid—enabling comparably longer storage of said plate.

It is another object of the present invention to provide a plate liner useful for resolving pendant drop formation issues in a microarray plate that uses as an underdrain with a spout opening by having the inner surface of spout isolator be closely adjacent to or in contact with the spouts so as to prevent any drop formation.

It is another object of the present invention to provide a plate liner comprising hermetic spout isolators optically configured to enable optical interrogation of a fluid therethrough.

It is another object of the present invention to provide a plate liner comprising hermetic spout isolators optically configured to enable optical interrogation of a fluid therethrough while preventing light contamination between adjacent spouts or wells.

For a further understanding of the nature of these and other objects of the invention, reference should be had to the following description taken in conjunction with the accompanying drawings.

BRIEF DESCRIPTION OF THE DRAWINGS

The illustrations in each of FIGS. 1 to 5 are schematic. The relative locations, shapes, and sizes of objects are exaggerated to facilitate discussion and presentation herein.

DETAILED DESCRIPTION

Figure 1:
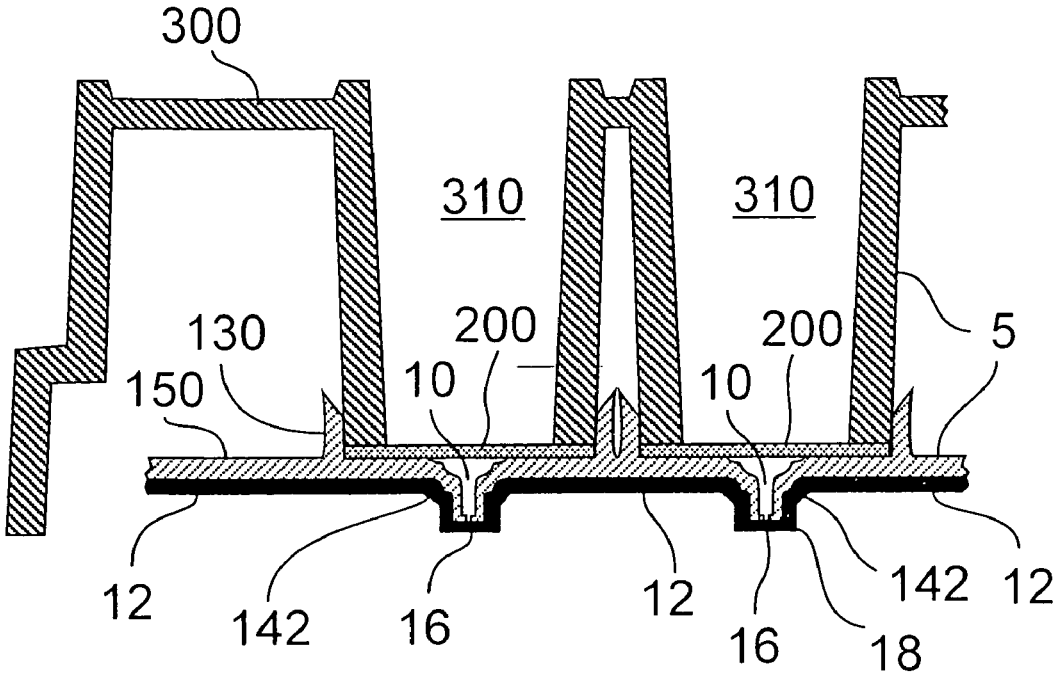
FIG. 1 illustrates, in cross-section, a microarray comprising an array 300 of wells 310 and an array 150 of underdrains onto which is detachably engaged a plate liner 12, configured according to an embodiment of the present invention.
Figure 2:
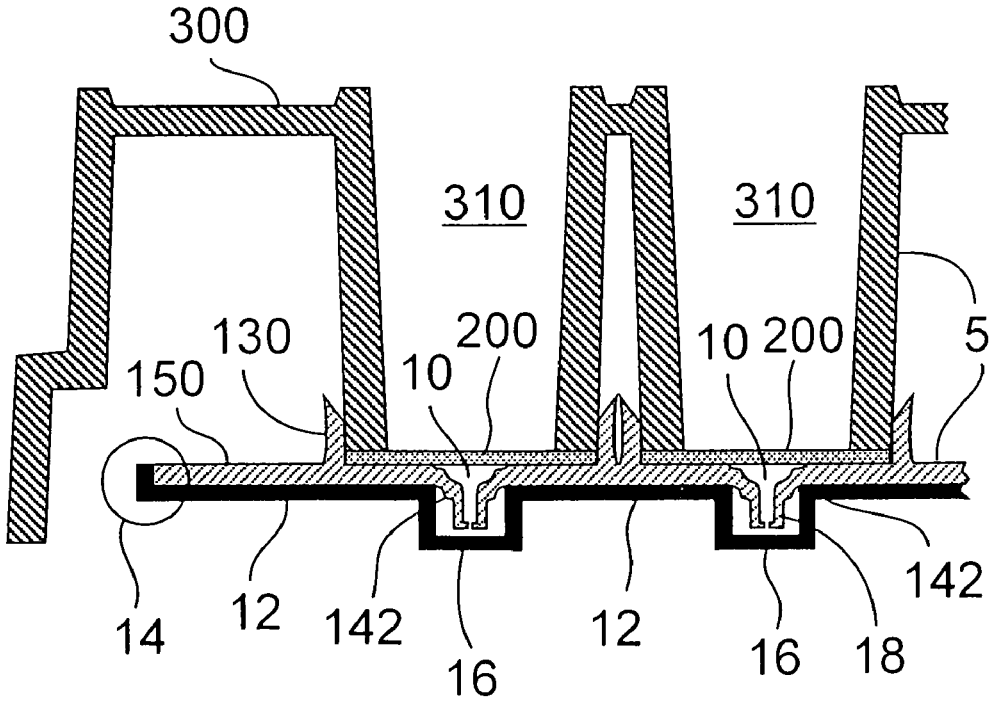
FIG. 2 illustrates, in cross-section, an alternative configuration of the plate liner 12 illustrated in FIG. 1.
Figure 3:
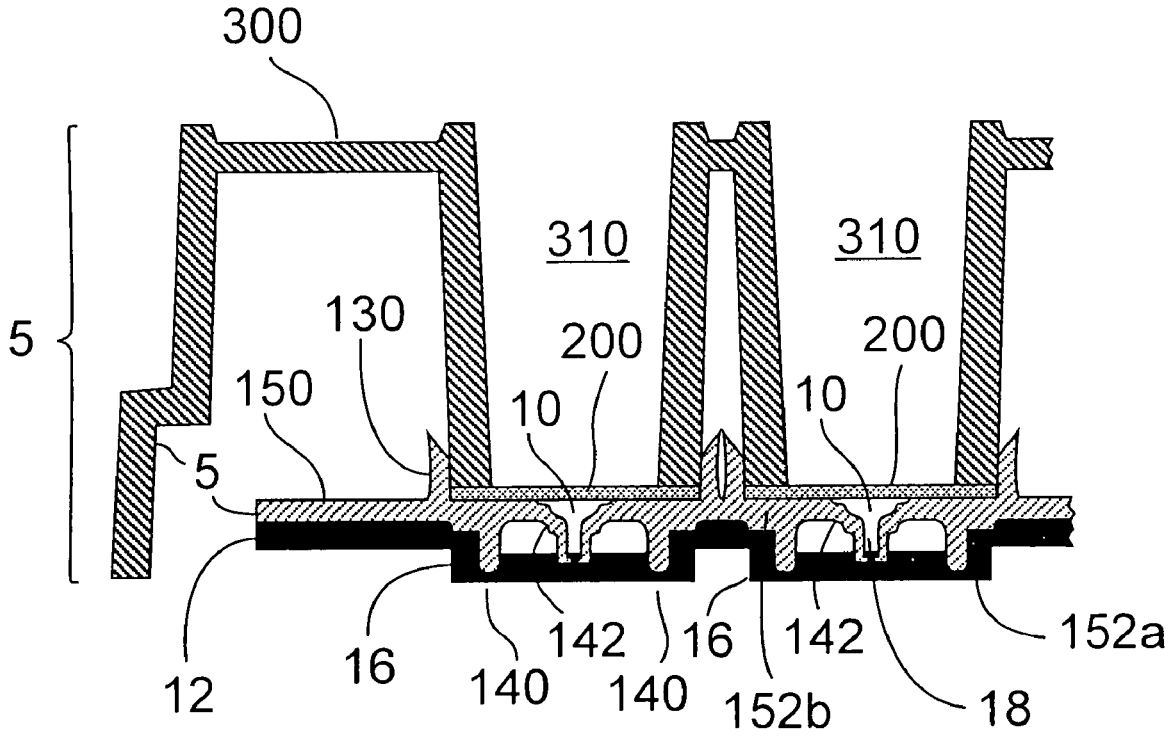
FIG. 3 illustrates, in cross-section, another alternative configuration of the plate liner 12 illustrated in FIG. 1.

Each of FIGS. 1 to 3 illustrate a representative embodiment of a plate liner 12, each well-suited for controlling pendant drop formation in the broad class of microarrays that comprise—in general—an array of wells 310 in a sample plate 300 and an array of underdrains 150.

The plate liner 12 is designed to engage detachably onto said specific pre-defined microarray, such that the force required to manually disengage the plate liner 12 from said specific pre-defined microarray is substantially less than the force required to separate the wells from the underdrains 150.

The plate liner 12 comprises an array of hermetic spout isolators 16 that will align or otherwise register well with the underdrains 150 when the plate liner is engaged. The close and structurally-appropriate conformity with which the plate liner 12 registers and engages the microarray is central to the invention's control of pendant drop formation. Fluid samples placed in wells 310 and passing into the underdrains 150 are hermetically blocked from flowing past the hermetic spout isolators 16.

The plate liner 12 is pre-configured to "detachably engage" a microarray by means of two basic alternative approaches.

In the first approach—which is preferably used for completely sealing off the underdrain spouts 10—the plate liner 12 is engineered to "engage detachably"by means of a friction-fitted coupling of the hermetic spout isolators 16 with underdrain spouts 10. Examples of such "detachable engagement" are illustrated in FIGS. 1 and 3. In FIG. 1, the hermetic spout isolators 16 follow closely the contours of the underdrain spouts 10, with the plate liner 12 facing flush against the underdrain plate 150. In FIG. 3, the hermetic spout isolators 16 also follow closely the contours of the underdrain spouts 10, but also conform to accommodate the presence of protective circular collars 140 that protrude from the planar underdrain support 150.

In the other approach—preferably used when the hermetic spout isolators 16 are formed as "micro-receptacles" incapable of "holding onto" the underdrain spouts 10—the plate liner 12 is engineered such that it "engages detachably"by means of one or more friction-fitted, peripheral edge couplings 14 of the plate liner 12 onto the microarray. Under such approach, the spout isolators in micro-receptacle form 16 are intended to capture only the substantially smaller volumes of fluid that drip incidentally out of the samples wells 310 through the spouts 10 during, for example, long sample incubation steps. They provide essentially protective functionality and are not generally intended to serve as fluid reservoirs (cf., receptacles 46 in FIG. 4). Hence, the fluid volume of each spout isolator in micro-receptacle form 16 will generally be "substantially less"than the volume of each sample well 310, if not "negligible" (i.e., approximately 0.025 ml to approximately 0.125 ml). Such small volume receptacles result in a relatively low profile plate liner 12 that can be engaged inconspicuously and/or unobtrusively onto a microarray, thereby promoting broader microarray stackability and mechanical compatibility with legacy and/or extant array handling, incubation, and sensing devices and hardware.

Although the embodiments shown in FIGS. 1 to 3 illustrate "friction fitted" engagement mechanisms, where appropriate, alternative, additional, and/or supplementary securement means can be employed, for example, the use of clamps, adhesives including those in tape form or as coatings, and mechanical couplers (e.g., snaps, interlocking grove and strips). These can be implemented to promote good hermetic seal formation by mitigating potential "buckling", "warping", and like deformations resultant of certain friction-fitted engagements (e.g., the securement of inner well regions with adhesive tape). The supplemental means can be provided as integrated features of the plate liner 12, such as a plate liner having an adhesive coating applied to the surface facing the underdrains. Optionally, the adhesive could have a peel away protective layer to prevent any premature use of the adhesive or—in respect of "kit" embodiments of the present invention—as independent components that are desirably pre-sterilized and pre-packaged with the rest.

Regardless of the means used to effect detachable engagement, the means should be constructed such that the force required to manually disengage the plate liner 12 from said drain plate 150 is substantially less than the force required to disengage or otherwise separate said drain plate 150 from said sample plate 300. As to the lower threshold, the force should be sufficient to "hold" the plate liner 12 securely in place, forming good water-tight seals, across a reasonably broad range of handling conditions. As to the upper threshold, ease of detachment is particularly important. Thus, even where the drain plate 150 and sample plate 300 are formed "monolithically" (i.e., wherein extreme forces would be required to break the underdrains off the sample wells), the force required to disengage the plate liner 12 should still be kept relatively low to promote and/or facilitate gentle, non-disruptive manual disengagement.

The principal functionality of the hermetic spout isolators 16 is to either (a) prevent the formation of pendant drops altogether or (b) contain pendant drops that do form. "Prevention" is best accomplished by a hermetic spout isolator 16 that closely conforms and engages with an underdrain spout 10 such that the aperture of said spout 10 is sealed by the isolator 16, as illustrated by the embodiment of FIG. 1. "Containment" is best accomplished, as illustrated by the embodiments of FIGS. 2 and 3, by a hermetic spout isolator 16 formed as a micro-receptacle that is capable of hermetically capturing fluid drops expressed out of said spouts 10 in a volume substantially less than the volume of said wells 310. Creating an air-tight hermetic seal outside and proximate the spout 10 can also prevent liquid from dripping into the spout isolators in micro-receptacle form because air trapped therein cannot be displaced.

In configuring the hermetic spout isolator 16, it is desirable to consider pendant drop theory and the maximum volumes that a spout of a given size and material can sustain. For example, a hermetic spout isolating micro-receptacle 16 should be deep enough to prevent drops of a certain size from contacting the plate liner and "touching off". Such contact has been shown to initiate flow from the device and can potentially drain the well of liquid. Certain spout sizes are capable of sustaining drops up to 20 microliters with heights of 0.100". A" " spout isolating micro-receptacle 16 would need to be at least 0.100" tall to prevent "touch off".

In both "prevention" and "containment" approaches, the flow of fluid through a spout 10 is hermetically isolated by a physical water-tight seal that forms at or around the spout 10 when the plate liner 12 is detachably engaged onto the microarray. Provided with a good seal, drops of fluid will not fall from the microarray during incubation, storage, and or handling; nor will fluid seep, crawl, and cross-contaminate neighboring sample cells.

Plate liner 12 is preferably cast, molded, or otherwise formed from polymeric material, such as thermoplastics and/or thermosets. The polymeric material should have high structural resolution, so that it is capable of forming thin wall structures, thereby reducing the liner's overall bulk. In selecting an appropriate polymeric material, certain other factors that may be considered include, for example, rigidity and elasticity; structural and thermal durability; weight; and cost. Rigidity and elasticity will influence, among other things, the "detachable engageability" of plate liner 12, as well as its ability to form good hermetic seals at or proximate the underdrain spouts 10. Structural and thermal durability promotes better resistance to the mechanical and thermal stresses often encountered, for example, during automated mechanical handling, autoclaving, steam sterilization, and the like. Weight to some extent will influence "detachable engageability". Lighter weight materials are preferred because they are less prone to premature detachment during vigorous handling. Finally, because microarrays are generally "single-use" items, the material and manufacturing costs of a plate liner 12 should coincide well with its likely disposability.

Examples of suitable polymeric material include, but are not limited to, polycarbonates, polyesters, nylons, PTFE resins and other fluoropolymers, acrylic and methacrylic resins and copolymers, polysulphones, polyethersulphones, polyaryl-sulphones, polystyrenes, polyvinyl chlorides, chlorinated polyvinyl chlorides, ABS and its alloys and blends, polyurethanes, thermoset polymers, polyolefins (e.g., low density polyethylene, high density polyethylene, and ultra-high molecular weight polyethylene and copolymers thereof), polypropylene and copolymers thereof, and metallocene generated polyolefins. Preferred polymers are polyolefins, in particular polyethylenes and their copolymers, polystyrenes, and polycarbonates.

The plate liner 12 is, for certain applications, desirably formed (entirely or partially) of an elastomeric material capable of facilitating and/or promoting good seal formation. In one desirable embodiment, the elastomeric material is overmolded or otherwise deposited on a base thermoplastic or thermoset plate liner at or proximate the boundaries circumscribing each hermetic spout isolator 16.

In one desirable embodiment, the hermetic spout isolators 16 of the plate liner 12 are formed as micro-receptacles that are particularly configured to enable automated optical interrogation of fluid captured therein. The use of light transmissive materials affords the possibility of forming or otherwise integrating optical elements and/or functionality into the design of the hermetic spout isolator 16. For example, the floor of the hermetic spout isolator can be shaped in the form of, for example, a concave, convex, spherical, or cylindrical lens. An integrated optical element can assist, enable, and or facilitate the optical identification, monitoring, detection, or analysis of the hermetic spout isolator 16 and/or its fluid charge. Preferred optical polymers include, but are not limited to, styrene, styrene acrylonitrile, and acrylics. Optical attenuation, if desired, can be achieved in said optical elements, for example, by the inclusion of pigments, dyes, fillers and other light absorbing materials. Common materials include carbon black, titanium dioxide and the like all of which are well known to one of ordinary skill in the industry.

Figure 5:
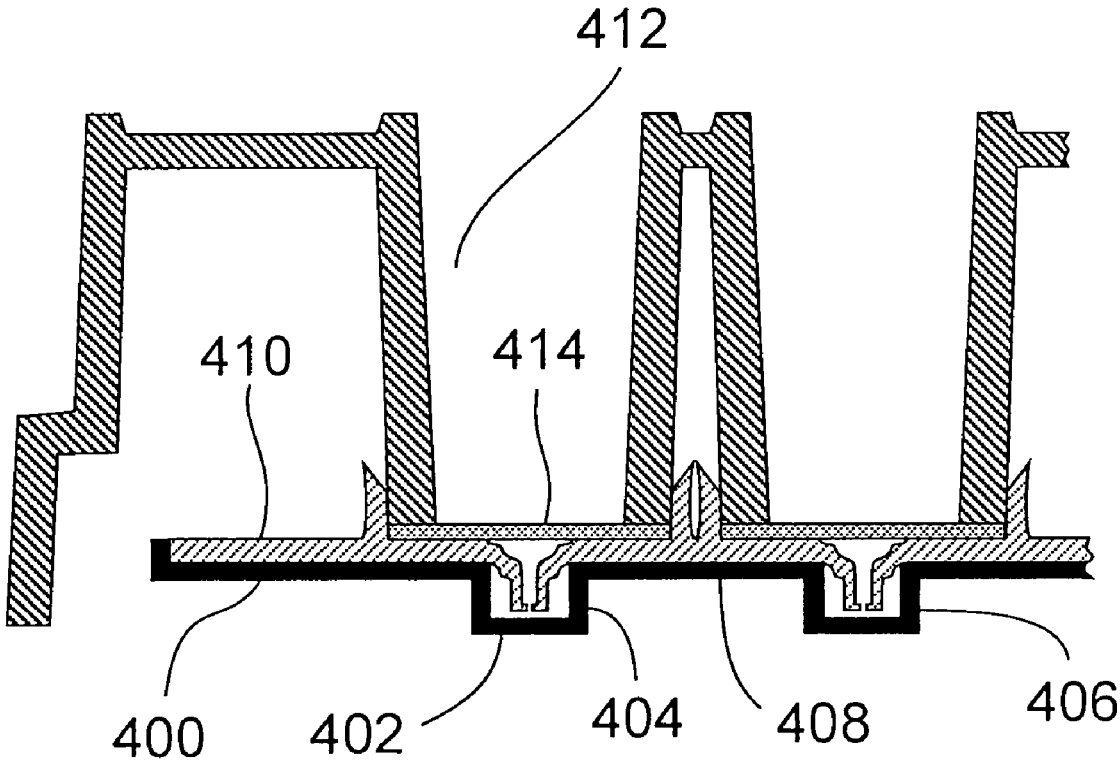
FIG. 5 illustrates a plate liner 12 with having opaque regions around each spout isolator 16.

FIG. 5 shows one such embodiment of an optically interrogatible plate liner 400. The areas of the plate liner 400 that are at least the bottom surfaces 402 of the spout isolators 404 are made of an optical polymer described above. In one embodiment, the sidewalls 406 of the isolators 404 as well as the web area 408 between the isolators 404 are formed of an optically attenuating material such as a polymer containing a dye, pigment, filler or other light absorbing material. When attached as described above to an underdrain 410 as shown, light is kept to the area of the well 412 and spout 414. This prevents light from one spout area from spreading to another spout area by what ever means such as transmission through the web area 408 of the plate liner 400 and/or reflection, refraction or transmission through the sidewalls 406. In some embodiments, the issue of light crosstalk is limited only to the web area 408 and the sidewalls 406 may is desired be clear and may even optically transmissive if desired (not shown). Such plate liners can be made by a variety of techniques depending on the format desired and the material used. For example one can co-mold two plastics, one of which contains the optically attenuating material for at least the web area and optionally the sidewalls as well. Alternatively, if a dye or ink or paint is used, the liner can be made of an optically transmissive polymer and the web area and optionally the sidewalls can then be coated with the optically attenuating material of choice. Other methods of forming the device according to this embodiment can be used as well and would be well known to one of ordinary skill in the art.

To facilitate use of the inventive plate liner for certain microarray-based protocols, in part by standardizing certain of its components, the present invention provides a kit that includes pre-selected compatible components suited for the accomplishment of said protocols. Although the kit by design targets pre-selected modes of practicing the invention, the inclusion of pre-selected compatible components promotes ease of use, consistency of results, and comparatively lower user costs.

In one embodiment, the microarray kit comprises, within sanitary packaging, a sample plate 300; a drain plate 150, and a plate liner 12, each of which are desirably "pre-sterilized".

The sample plate 300 and drain plate 150 comprise, respectively, an array of wells 310 and array of underdrains 10. The drain plate 150 is detachably engaged or engageable onto said sample plate 300 such that, when engaged, the array of underdrains 10 are sufficiently in register with said wells 310 to enable flow of fluid from said well 310 immediately into said underdrains without cross-contamination.

The "matching", plate liner 12 comprises an array of hermetic spout isolators 16, and is detachably engaged or engageable manually onto said drain plate 150. When engaged, the hermetic spout isolators 16 are in register with said underdrains 10, such that (a) the flow of fluid placed in said wells 310 and passing into said underdrains 10 is hermetically blocked from flowing past the hermetic spout isolators 16; and (b) the force required to manually disengage the plate liner 12 from said drain plate 150 is substantially less than the force required to disengage said drain plate 150 from said sample plate 300.

Pre-sterilization of the component parts of the inventive kit can be accomplished, for example, by steam sterilization, photo-irradiation, and/or by chemical treatment. As a further safeguard, each component part can be individually and sanitarily packaged within a larger outer sanitary package.

The plate liner 12 of the present invention can be provided as a "stand-alone" item, or—more preferably—as a pre-matched component of the aforementioned kit. In either case, the microarray device to which it engages will in general comprise an array of underdrains 10 and an array of sample wells 310. For purposes of illustration, representative examples of such microarray device are provided in FIGS. 1 to 3.

As shown in FIGS. 1 to 3, an underdrain—having a monolithic construction—is provided with certain structural features above and below (i.e., upstream and downstream, respectively) a planar support 150. These structural features substantially encircle (or otherwise surround) a central funnel-shaped opening 142 that leads into and through the planar support 150.

On the downstream surface of the planar support 150, there is provided a tube-shaped spout 10 aligned co-axially with and below the funnel-shaped opening 142 and optionally—as shown in FIG. 3—a protective circular collar 140 co-axially surrounding the tubular spout 10 with a plurality of spacers 152*a* and 152*b* formed between the lower surface of the planar support 150 and the outer wall of the protective circular collar 140. On the upstream surface of the planar support 150 there is provided circular engaging means 130 for fixing a well to the underdrain, the circular engaging means being aligned co-axially with and above the funnel-shaped opening 142. Although the tubular spout 10, the funnel-shaped opening 142, and.the circular engaging means 130 are all co-axial in FIGS. 1 to 3, such alignment is not pivotal. An offset arrangement can be employed if desired.

To further promote good pendant drop control, the underdrain spouts 10 of the drain plate 150 packaged within the inventive kit are desirably configured with straight side walls. In particular, the outer side wall of spout 10 should run substantially parallel to the spout's central axis, wherein said central axis generally corresponds to the flow path through the spout 10. In a typical application—e.g., the application of the kit's microarray filtration device onto a vacuum manifold—the outer side wall(s) of spout 10 configured as such will likely also be substantially parallel to the direction in which fluid is expressed out of the spout 10 into a receiving element. This—it is felt—provides distinct advantage. As a drop of fluid forms on the tip of a spout, prior to falling off, it is gravitationally more difficult for said drop to contact and creep significantly up a steep straight side wall than would be the case, for example, with a gradual upward and outwardly inclined side wall.

In order to realize the advantages offered by the straight side wall, the length of said wall should be fairly substantial. While it is not required that the entire length of the outer side surface of spout 10 be straight, little advantage is offered where the straight side walls occupies, for example, only the rim of the spout. While there is no particular absolute "cut off" in respect of length, it is envisaged that in most circumstances, the outer side surface will run substantially parallel to said central axis of the spout (i.e., "straight") from its furthest downstream end to at least a point corresponding to midway the spout 10's fluid pathway.

A further impediment to pendant drop up-crawl is provided by the roughly textured outer side and end surfaces of the spout 10. It will be appreciated that the spout may likely be already made of (or coated with) a polymeric material that inherently possesses some measure of hydrophobicity. It is currently believed that a roughly textured outer surface—which in accordance with the present invention comprises a coarse microstructure of cracks, crevices, pits, ridges, bumps, and/or like peaks and valleys—can enhance this inherent hydrophobicity, by disrupting, reducing, and/or rendering more tortuous the surface area(s) upon which a drop of aqueous fluid could otherwise "crawl" (for example, by capillary action). Although one could have expected the opposite effect (i.e., hydrophilicization), repeatable and consistent empirical data were collected validating the positive effect of a roughened spout surface on pendant drop formation.

The coarse microstructure can be provided on the spout either during the forming of the underdrain (for example, by use of an appropriately roughly textured mold), or subsequently, by well-known mechanical and chemical surface roughening processes. Mechanical processes include, but are not limited to, embossing, etching, and treatment with abrasives. Chemical processes include, but are not limited to, treatment with caustic, acidic or other corrosive solutions, thermal and/or photodegradation, and laser ablation.

Funnel-shaped opening 142 provides a gradual transition for fluid to flow from a comparatively more spacious well (e.g., well 310) into the much more constricted fluid pathway of spout 10. The furthest downstream end of funnel-shaped opening 142 merges smoothly into fluid pathway of tubular spout 10, at which point the diameter of opening 142 is equal to that of fluid pathway. In practice, the diameter of the fluid pathway 18 should be sufficiently small, such that—with the combined influence of the material surface properties of the underdrain—fluid within funnel-shaped opening 142 (and hence, fluid within a filtration device) will not flow therethrough until a sufficient predetermined driving force (e.g., vacuum pressure, positive pressure, centrifugal force, etc.) is attained.

The protective circular collar 140 serves a number of functions. For certain applications, the protective circular collar 140 serves as an alignment guide, which is useful in instances wherein underdrain is to be aligned with a downstream fluid receptacle. In this regard, the protective circular collar 140 is formed to enable the nesting thereof within the corresponding, comparatively large volume, fluid collection receptacle 46 into which filtrate is to be transferred downstream. Lateral movement of the fluid collection receptacle is repressed by the protective circular collar which is generally tightly seated within said receptacle 46.

For applications not involving a fixed downstream fluid receptacle—e.g., wherein filtrate is not collected, but discharged as waste—the protective circular collar 140 serves also to minimize any contamination between wells and/or surrounding areas by guarding against aerosols or the splashing of the liquid filtrate as it is dispensed through the spout 10.

Further still, the protective circular collar 140 can be constructed such that its protrudes from planar support 150 to an extent further than the tubular spout 10, thus offering some measure of physical protection to the tubular spout 10 from damage that may be encountered during assembly, use, or possible disassembly of a filtration device.

Spacers 152*a* and 152*b*—though not immediately apparent from FIG. 3—are block-like structures that radiate outwardly from the outer wall of the protective circular collar 140. In addition to providing some lateral support to the protective circular collar 140, spacers 152*a* and 152*b* also prevent a lower corresponding fluid collection receptacle 46 from pressing completely up against planar support 150, and creating an air tight seal that would prevent or otherwise frustrate the evacuation of a fluid though the filtration device 5. Provision of intermittently positioned spacers provides air gaps, enabling the displacement of air throughout the device, as is needed, for example, in both vacuum- and centrifugally-driven filtration.

Well engaging means 130 on the upstream side of the planar support 150 is configured as an annular seat into which a well can be pushed into, in a manner comparable to the aforementioned relationship between the protective circular collar 140 and the fluid receptacle 46. A well 310 is typically fixed within annular well-engaging means 150 by friction. However, for certain applications, one can use, for example, adhesives, thermal welds, or mechanically interlocking couplers. Preferably, unlike the protective circular collar, annular well engaging means 130 "fits" around the well 310's bottom end, rather than the well 310 fitting around the well engaging means 130.

The permanency of the fixation of a well 310 onto the underdrain 100 by said well engaging means 130 depends on intended use. For certain applications, advantage is realized by engineering the well-engaging means 150 such that the fixation of a well therewith is "sufficiently tight" to enable "clean" clinically-acceptable filtration, yet "sufficiently loose" to enable a relatively non-destructive disassembly of the resultant filtration device. Such disassembly, for example, can provide a practitioner additional avenues (not otherwise available) for observing, testing, or otherwise inspecting the separation material (e.g., a membrane) interposed between the mated well and underdrain. Such inspection often yields meaningful information.

Each well 310 of the plate 300 is preferably matched in a 1:1 ratio to each underdrain in the underdrain plate. Separation material is provided between the plates, for example, in the form of several individual membranes 200 discretely interposed between each coupled well/underdrain pair.

Although in FIGS. 1 to 3, the microarray filtration device comprises a plate-like array of wells and a corresponding plate-like array of underdrains, the underdrains need not in all instances be provided collectively in one component. In particular, a filtration device is contemplated wherein discrete underdrains are individually "press fitted" onto the bottom end of the plate's wells.

When paired plate-like arrays of wells and underdrains are used, it is important that the wells of the first plate register with the underdrains of the second plate. Typically, as earlier indicated, multiwell plates can be made in formats containing 6-wells, 96-wells, 384-wells, or up to 1536-wells and above. The number of wells used is not critical to the invention. The wells are typically arranged in mutually perpendicular rows. For example, a 96 well plate will have 8 rows of 12 wells. Each of the 8 rows is parallel and spaced apart from each other. Likewise, each of the 12 wells in a row is spaced apart from each other and is in parallel with the wells in the adjacent rows. A plate containing 1536 wells typically has 128 rows of 192 wells.

The separation material 200 is placed substantially between the well(s) and the underdrain(s), such that fluid placed in a well is flowable first into and through the separation material 200, then into and ultimately out of the underdrain. The separation material can be any material specifically engineered for, and thus, capable of isolating, screening, binding, removing, or otherwise separating a predetermined target (e.g., viruses, proteins, bacteria, particulate matter, charged or otherwise labeled compounds, biochemical fragments, etc.) from a fluid stream passing therethrough. The determinants of separation can be based, for example, on the size, weight, surface affinities, chemical properties, and/or electrical properties of the predetermined target.

The separation material is preferably located at or close to the bottom of the well. Such placement—it is felt—can reduce incidence of so-called "vapor locking" that can occur when a well is repetitively filled and vacuum filtered.

The preferred separation material is a filtration membrane. The filtration membrane can be bonded to the well (or the underdrain) or can be held in position by being compressed between the well and the underdrain. Any bonding method can be utilized. Representative suitable membranes are the so-called "microporous" type made from, for example, nitrocellulose, cellulose acetate, polycarbonate, and polyvinylidene fluoride. Alternatively, the membranes can comprise an ultrafiltration membrane, which membranes are useful for retaining objects as small as about 100 daltons and as large as about 2,000,000 daltons. Examples of such ultrafiltration membranes include polysulfone, polyvinylidene fluoride, cellulose, and the like.

Aside from membranes, other separation materials include, depth filter media (such as those made from cellulosic or glass fibers), loose or matrix-embedded chromatographic beads, frits and other porous partially-fused vitreous substance, electrophoretic gels, etc. These separation materials—as well as membranes—can further comprise or be coated with or otherwise include filter aids and like additives, or other materials, which amplify, reduced, change, or otherwise modify the separation characteristics and qualities of the base underlying material, such as for example the grafting of target specific binding sites onto a chromatographic bead.

When incorporated into a microarray filtration device, the separation material can be interposed between the paired wells and underdrains either "expansively" (e.g., using one membrane sheet to cover all pairs) or "discretely" (e.g., using separate and discrete membranes for each pair). When the separation material is interposed expansively, care should be taken to minimize or otherwise frustrate fluid "cross-talk" between the pairs that can occur as fluid spreads laterally through the separation material, such as by using the well-known separations materials that are constructed specifically to contain (as in zones), mitigate, frustrate, or prevent lateral cross-flow.

When the separation material is interposed discretely between each well/underdrain pair, care should be taken to assure a good fit therein. In this regard, it is possible to cut a filter sheet by means of other cutting techniques, such as laser cutting, cutting by means of water jets, or by providing sharp edges circumscribing the bottom opening of the wells or circumscribing the upper opening of the underdrain. With respect to the latter, an appropriately-sized, well-fitting discrete filter element can be simultaneously punched out and appropriately positioned in each well/underdrain pair by placing an expansive sheet between the array of wells and the array of underdrains, and then pressing them tightly together. The sheet in this regard, can be initially bonded or secured to the array of wells, or the array of underdrains, or neither (i.e., loose).

As an alternative to packaging individual complementary well and underdrain plates within the inventive kit, a monolithic microarray filtration device is contemplated wherein the wells and underdrains thereof are not formed separately. Rather, each well in said monolithic microarray filtration device is provided with an underdrain that is formed continuously therewith. Separation material is installed within the device, for example, in the same manufacturing step (or steps) in which the underdrain-bearing well is formed, and such that, in the resultant monolithic microarray filtration device, the flow path of fluid therethrough will be essentially the same as the flow path provided by a two-piece construction. In accord with the invention, the detachably engageable plate liner 12 can engage onto either the underdrain spouts or onto a peripheral edge of the monolithic construction.

Although the monolithic microarray filtration device cannot be easily separated like the two-piece construction for inspection and analysis of enclosed separation material, it tends to be more structurally robust, and is better suited for robotic handling, and is less likely to leak, and is less vulnerable to interwell cross-talk.

Figure 4:
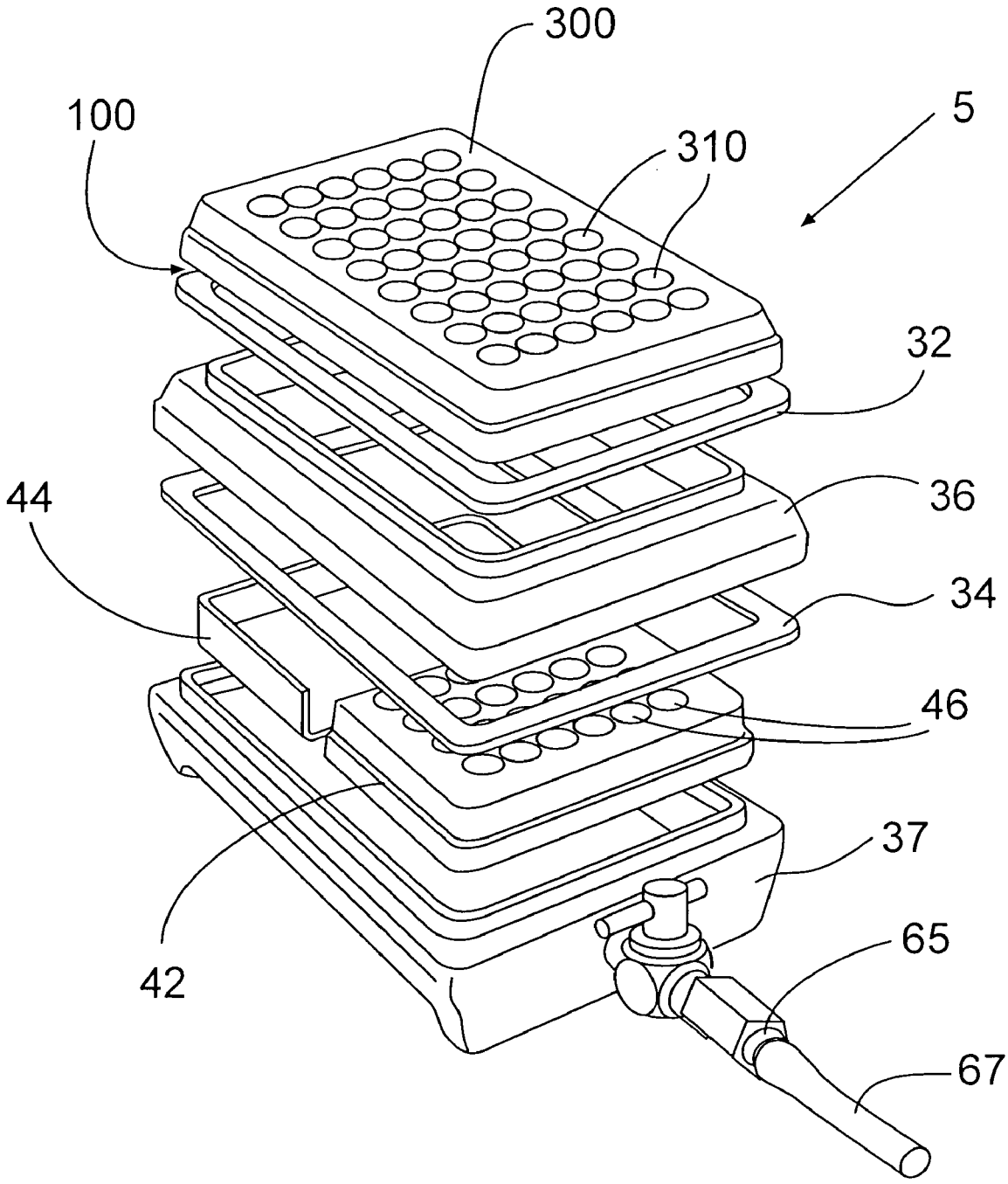
FIG. 4 illustrates the application of a microarray onto a vacuum manifold 37.

In practice, after being charged with fluid samples, at the conclusion of all desired sample treatment procedures, microarray filtration device 5 is drained typically (though not necessarily) by drawing a vacuum through the device 5 such the fluid sample in each well 310 flows into and out of each respective underdrain 100 through separation material 200. An example of a vacuum manifold assembly suitable for such the conduct of such process is shown in FIG. 4. The vacuum manifold assembly of FIG. 4 comprises a base 37, which acts as a vacuum chamber and contains hose barb 65 for connection to an external vacuum source through hose 67. Positioned within the base 37 are liquid collection means such as either a collection tray 44 and/or a receiving plate 42 having a plurality of receptacles 46 for collecting fluid flowing out of each corresponding underdrain. The individual chambers 46 are associated each with a single well 310 in the well array 300 of the microarray filtration device 5. A microarray support 36 holding the microarray filtration device 5 above the fluid collection means is separated by gaskets 32 and 34 which form an airtight seal in the presence of a vacuum.

Although certain embodiments of the invention are disclosed, those skilled in the art, having the benefit of the teaching of the present invention set forth herein, can affect numerous modifications thereto. These modifications are to be construed as encompassed within the scope of the present invention as set forth in the appended claims.

The invention claimed is:

1. A sterile microarray kit comprising, within packaging, the following:

(a) a sample plate comprising an array of wells;

(b) a drain plate comprising an array of underdrains, each underdrain comprising an upstream end and a downstream end, with a spout provided at said downstream end that enables fluid to flow out of said underdrain, and the drain plate being engaged onto said sample plate such that the array of underdrains are in register with said wells, and whereby fluid placed in said wells flow into said underdrains when the drain plate is engaged onto said sample plate; and (c) a single continuous plate liner comprising an array of hermetic spout isolators, the plate liner being detachably engaged or engageable manually onto said drain plate such that the hermetic spout isolators are in register with said underdrains, wherein a hermetic seal is formed at or around the underdrain spouts when the plate liner is engaged onto the drain plate, and wherein:

(i) the flow of fluid placed in said wells and passing into said underdrains is hermetically blocked from flowing past the hermetic spout isolators when the plate liner is engaged onto said drain plate, wherein the hermetic spout isolators are capable of either prevention of pendant drop formation or containment of pendant drop formation is a pendant drop is formed, such that any appreciable amount of fluid placed in the wells is prevented from leaving the wells or the underdrains when the plate liner is engaged onto the drain plate, and if any fluid leaves the wells, the volume of such fluid is substantially less or negligible compared to the fluid volume of said wells, and (ii) the force required to disengage the plate liner from said drain plate is substantially less than the force required to disengage said drain plate from said sample plate.

2. The sterile microarray kit of claim 1, wherein said plate liner is detachably engaged or engageable onto said drain plate by means of individual friction-fitted couplings of said hermetic spout isolators with said spouts.

3. The sterile microarray kit of claim 1, wherein said plate liner is detachably engaged or engageable onto said drain plate by means of friction-fitted coupling of said plate liner onto the periphery of said drain plate; and.

4. The sterile microarray kit of claim 3, wherein:

hermetic spout isolators are optically configured to enable automated optical interrogation of fluid captured therein.

5. A single continuous plate liner suited for controlling pendant drop formation in a specific pre-defined microarray, wherein said microarray comprises an array of wells in a sample plate and an array of underdrains in a drain plate, wherein each underdrain of said drain plate has an upstream end and a downstream end, with a spout provided at said downstream end that enables fluid to flow out of said underdrain and wherein said drain plate is engaged to a bottom surface of said sample plate, and wherein:

(a) the plate liner engages detachably onto said microarray, such that the force required to manually disengage the plate liner from said microarray is substantially less than the force required to separate said sample plate from said drain plate; and (b) the plate liner comprises an array of hermetic spout isolators that are in register with said underdrains, and wherein a hermetic seal is formed at or around the underdrain spouts when the plate liner is engaged onto said specific pre-defined microarray, wherein the hermetic spot isolators are capable of either preventing pendant drop formation or containment of pendant drop formation, if a pendant drop is formed.

6. The plate liner of claim 5, wherein said detachable engagement of said plate liner onto said microarray is effected by means of individual friction-fitted couplings of said hermetic spout isolators with said spouts.

7. The plate liner of claim 5, wherein said detachable engagement of said plate liner onto said microarray is effected by means of friction-fitted coupling of said plate liner onto a periphery of the microarray.

8. The plate liner of claim 5, wherein the spout isolators are optically configured to enable automated optical interrogation of fluid captured therein.

9. The sterile microarray kit of claim 1, wherein:

(a) said plate liner is detachably engaged or engageable onto said drain plate by means of friction-fitted coupling of said plate liner onto the periphery of said drain plate;

(b) hermetic spout isolators are optically configured to enable automated optical interrogation of fluid captured therein; and (c) at least a web area of the plate liner between the hermetic spout isolators is formed of a light opaque material.

10. The sterile microarray kit of claim 1, wherein:

(a) said plate liner is detachably engaged or engageable onto said drain plate by means of friction-fitted coupling of said plate liner onto the periphery of said drain plate;

(b) the hermetic spout isolators are optically configured to enable automated optical interrogation of fluid captured therein; and (c) a web area of the plate liner between the hermetic spout isolators and sidewalls of the hermetic spout isolators are formed of a light opaque material.

11. The sterile microarray kit of claim 1 wherein the spout isolators are optically configured to enable automated optical interrogation of fluid captured therein.

12. The plate liner of claim 5, wherein said hermetic spout isolators are capable of hermetically capturing fluid drops expressed out of said spouts in a volume substantially less than the volume of said wells and are optically configured to enable automated optical interrogation of fluid captured therein.

13. The plate liner of claim 5, wherein said hermetic spout isolators are capable of hermetically capturing fluid drops expressed out of said spouts in a volume substantially less than the volume of said wells, are optically configured to enable automated optical interrogation of fluid captured therein and at least a web area between the isolators is formed of a light opaque material.

14. The plate liner of claim 5 wherein said hermetic spout isolators are capable of hermetically capturing fluid drops expressed out of said spouts in a volume substantially less than the volume of said wells, are optically configured to enable automated optical interrogation of fluid captured therein and a web area between the isolators and sidewalls of the isolators are formed of a light opaque material.

* * * * *

UNITED STATES PATENT AND TRADEMARK OFFICE

CERTIFICATE OF CORRECTION

PATENT NO. : 7,618,592 B2
APPLICATION NO. : 11/142542
DATED : November 17, 2009
INVENTOR(S) : Burnham et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1071 days.

Signed and Sealed this

Twenty-sixth Day of October, 2010

David J. Kappos

David J. Kappos
*Director of the United States Patent and Trademark Office*